US009534752B1

(12) United States Patent
Mishan

(10) Patent No.: US 9,534,752 B1
(45) Date of Patent: Jan. 3, 2017

(54) FLEXIBLE TWO HEADED FLASHLIGHT

(71) Applicant: E. Mishan & Sons, Inc., New York, NY (US)

(72) Inventor: Dylan Mishan, New York, NY (US)

(73) Assignee: E. Mishan & Sons, Inc., New York, NY (US)

( * ) Notice: Subject to any disclaimer, the term of this patent is extended or adjusted under 35 U.S.C. 154(b) by 0 days.

(21) Appl. No.: 14/825,819

(22) Filed: Aug. 13, 2015

(51) Int. Cl.

| | |
|---|---|
| ***F21L 4/02*** | (2006.01) |
| ***F21V 23/04*** | (2006.01) |
| ***F21V 17/10*** | (2006.01) |
| ***F21V 21/14*** | (2006.01) |
| *F21Y 101/02* | (2006.01) |

(52) U.S. Cl.
CPC ..... *F21L 4/027* (2013.01); *F21V 17/105* (2013.01); *F21V 21/145* (2013.01); *F21V 23/0414* (2013.01); *F21Y 2101/02* (2013.01)

(58) Field of Classification Search
CPC ..... F21L 4/027; F21V 21/145; F21V 17/105; F21V 23/0414
USPC ..... 362/108, 184, 190, 191, 249.08, 398
See application file for complete search history.

(56) References Cited

U.S. PATENT DOCUMENTS

| | | | |
|---|---|---|---|
| D268,442 | S | 3/1983 | Darmon |
| D306,351 | S | 2/1990 | Charet et al. |
| 5,570,949 | A | 11/1996 | Chiang |
| 5,571,279 | A | 11/1996 | Chiang |
| D379,542 | S | 5/1997 | Egashira |
| D388,524 | S | 12/1997 | Shiau |
| 5,717,276 | A | 2/1998 | Hsu |
| 5,749,644 | A | 5/1998 | Carbone |
| D404,157 | S | 1/1999 | Carbone |
| 6,004,004 | A | 12/1999 | Altman et al. |
| 6,280,050 | B1 | 8/2001 | Bird et al. |
| D476,106 | S | 6/2003 | Kim |
| D479,888 | S | 9/2003 | Sharrah et al. |
| 6,680,844 | B2 | 1/2004 | Kim |
| D489,839 | S | 5/2004 | Opolka |
| 6,874,908 | B2 | 4/2005 | Sharrah et al. |
| RE38,897 | E | 11/2005 | Krenzel |
| D518,212 | S | 3/2006 | Shiu |
| D527,476 | S | 8/2006 | Craft |
| D536,116 | S | 1/2007 | Sharrah |
| 7,175,295 | B2 | 2/2007 | Bretz et al. |
| D560,014 | S | 1/2008 | Lammel et al. |
| D563,011 | S | 2/2008 | Major et al. |

(Continued)

FOREIGN PATENT DOCUMENTS

| | | |
|---|---|---|
| CN | 201475669 U | 5/2010 |
| CN | 202647208 U | 1/2013 |

(Continued)

*Primary Examiner* — Laura Tso
(74) *Attorney, Agent, or Firm* — Notaro, Michalos & Zaccaria P.C.

(57) ABSTRACT

A flexible, two headed flashlight arrangement has a bendable elongated shaft with opposite ends, the shaft having a thin diameter of selected length and being bendable into any selected shape and a separate self-powered flashlight assembly fixed to each end of the shaft. Each flashlight assembly comprising a housing containing an LED circuit with at least one LED, a switch having open and closed positions for respectively interrupting and passing electricity to the LED, and at least one battery for powering the LED when the switch is closed.

19 Claims, 6 Drawing Sheets

(56) References Cited

U.S. PATENT DOCUMENTS

| | | | | |
|---|---|---|---|---|
| D571,942 | S | 6/2008 | Christianson | |
| 7,429,123 | B2 | 9/2008 | Moore | |
| D588,735 | S | 3/2009 | Woodard | |
| 7,510,295 | B2 | 3/2009 | Shih | |
| D591,438 | S | 4/2009 | Hama et al. | |
| D623,783 | S | 9/2010 | Christianson et al. | |
| D673,710 | S | 1/2013 | Eichelberger | |
| 8,403,515 | B2 | 3/2013 | Eichelberger et al. | |
| D699,875 | S | 2/2014 | Christianson et al. | |
| D700,383 | S | 2/2014 | Seidl et al. | |
| D723,202 | S | 2/2015 | Windom et al. | |
| 9,303,832 | B2 * | 4/2016 | Sun | F21L 4/04 |
| 2003/0161143 | A1 | 8/2003 | Parker et al. | |
| 2004/0174703 | A1 | 9/2004 | Tally | |

FOREIGN PATENT DOCUMENTS

| | | | |
|---|---|---|---|
| CN | 202647209 | U | 1/2013 |
| CN | 203323046 | U | 12/2013 |
| CN | 203363701 | U | 12/2013 |

* cited by examiner

FLEXIBLE TWO HEADED FLASHLIGHT

FIELD AND BACKGROUND OF THE INVENTION

The present invention relates generally to the field of flashlights, and in particular, to a new and useful, flexible, two headed flashlight arrangement.

U.S. Pat. No. 8,746,918 to Rubino discloses a telescopic flashlight that includes an adjustable mirror with flashlight section at one end of a flexible, bendable member, and a battery housing at the opposite. U.S. Pat. No. 7,510,295 to Shih discloses as similar item but without a mirror.

A flashlight arrangement with two light sources at opposite ends of a flexible member known as the HUGLight can be viewed at URL: http://showertek.com/collections/mirror-lights-more/products/huglight. The HUGLight uses an enlarged battery compartment at an intermediate location along the length of the flexible member.

Another flashlight product called the 24-LED Twist Light Flexible Flashlight/Lantern Work Repair Safety HB is available at: http://www.ebay.com/sch/sis.html?_nkw=24%20LED%20Twist%20Light%20Flexible%20Flashlight%20Lantern%20Work%20Repair%20Safety%20HB%20Smith%20Tools&_itemId=20124533 0449. This product has two lights at opposite ends of a flexible member, but the flexible member is a large diameter, corrugated structure that is difficult to wrap around other structures and even less amenable to being wrapped around the hand or arm of a user.

A need remains for an improved flexible flashlight arrangement with two self-powered light emitting ends and a thin, elongated, easily bend-to-shape flexible member between them.

SUMMARY OF THE INVENTION

It is an object of the present invention to provide such an improved flexible flashlight arrangement with two self-powered light emitting ends and a thin, elongated, easily bend-to-shape flexible member between them, that can be wrapped around the hand or arm or leg of a user, or over the back of the user's neck or over the used's shoulder, or around poles, posts or other supporting structure, or be bent to a shape for supporting on a flat surface, while one or both of the light emitting ends are bent to shine light in one or two desired directions.

Accordingly, another object of the invention is to provide a flexible, two headed flashlight arrangement, comprising: a bendable elongated shaft having opposite ends, the shaft having a diameter of about 5 mm (about 3/16 inch) to about 10 mm (about 3/8 inch) and preferably about 6 mm (about 1/4 inch), that is substantially constant between the opposite ends, a length of about 610 mm (about 24 inch) to about 1220 mm (about 48 inch) and preferably about 915 mm (about 36 inch), and being bendable into any selected shape; and a separate self-powered flashlight assembly fixed to each end of the shaft, each flashlight assembly comprising a housing containing an LED circuit with at least one LED, a switch having open and closed positions for respectively interrupting and passing electricity to the LED and at least one battery for powering the LED when the switch is closed.

A still further object of the invention is to provide a flexible, two headed flashlight arrangement, comprising: a bendable elongated shaft having opposite ends; and a separate self-powered flashlight assembly fixed to each end of the shaft, each flashlight assembly comprising a housing containing an LED circuit with at least one LED, a switch having open and closed positions for respectively interrupting and passing electricity to the LED and at least one battery for powering the LED when the switch is closed; the bendable elongated shaft comprising an inner spring metal coil, an outer malleable metal coil coiled around the inner coil with turns that alternate with turns of the inner coil, and an optional elastomer cover over the outer coil.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which at least one preferred embodiment of the invention is illustrated.

DESCRIPTION OF THE PREFERRED EMBODIMENTS

Figure 1:
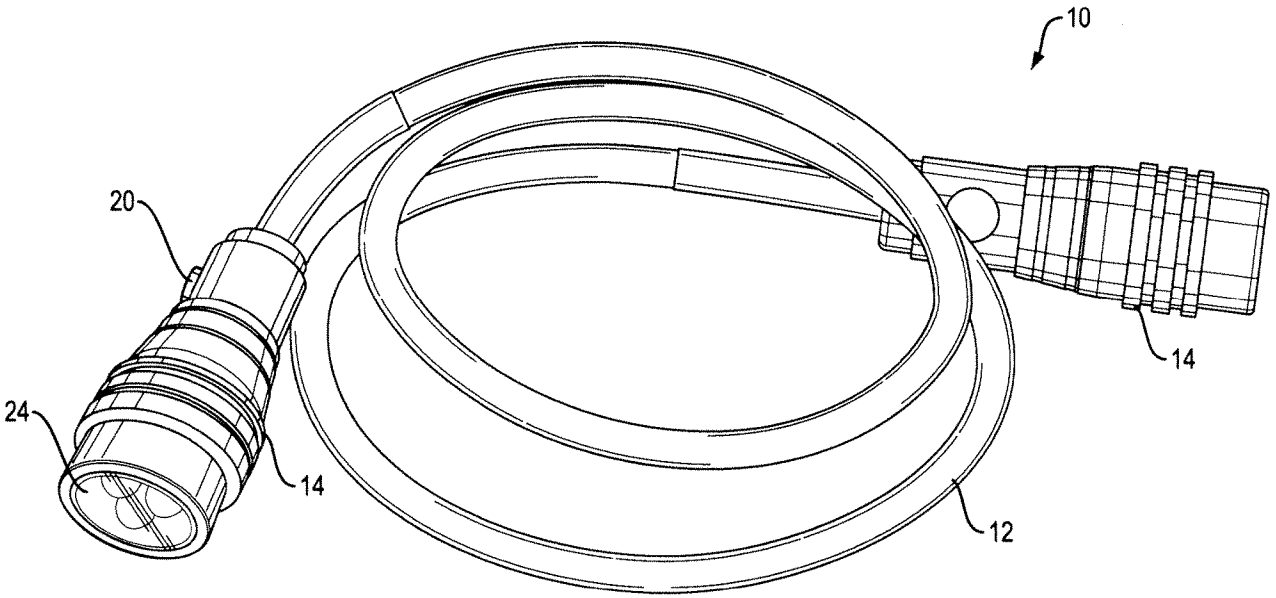
FIG. 1 is a perspective view of a flexible, two headed flashlight arrangement of the invention.

Referring now to the drawings, in which like reference numerals are used to refer to the same or similar elements, FIG. 1 shows a flexible, two headed flashlight arrangement 10 that includes a bendable at least partly metal, elongated shaft 12 having opposite ends, the shaft having a diameter of about 5 mm (about 3/16 inch) to about 10 mm (about 3/8 inch) and that is substantially constant between the opposite ends. The shaft 12 has a length of about 610 mm (about 24 inch) to about 1220 mm (about 48 inch), and being bendable into any selected shape. The preferred diameter of shaft 12 is about 6 mm (about 1/4 inch), and the preferred length is about 915 mm (about 36 inch). These dimensions have been found to provide maximum utility in that the long thin and bendable shaft with two flashlight assemblies is light and can be bent for use in a wide variety of configurations. The lack of any enlarged battery compartment or other structure along the substantially constant diameter length of the bendable shaft 12, greatly facilitates this versatile capacity.

Figure 2:
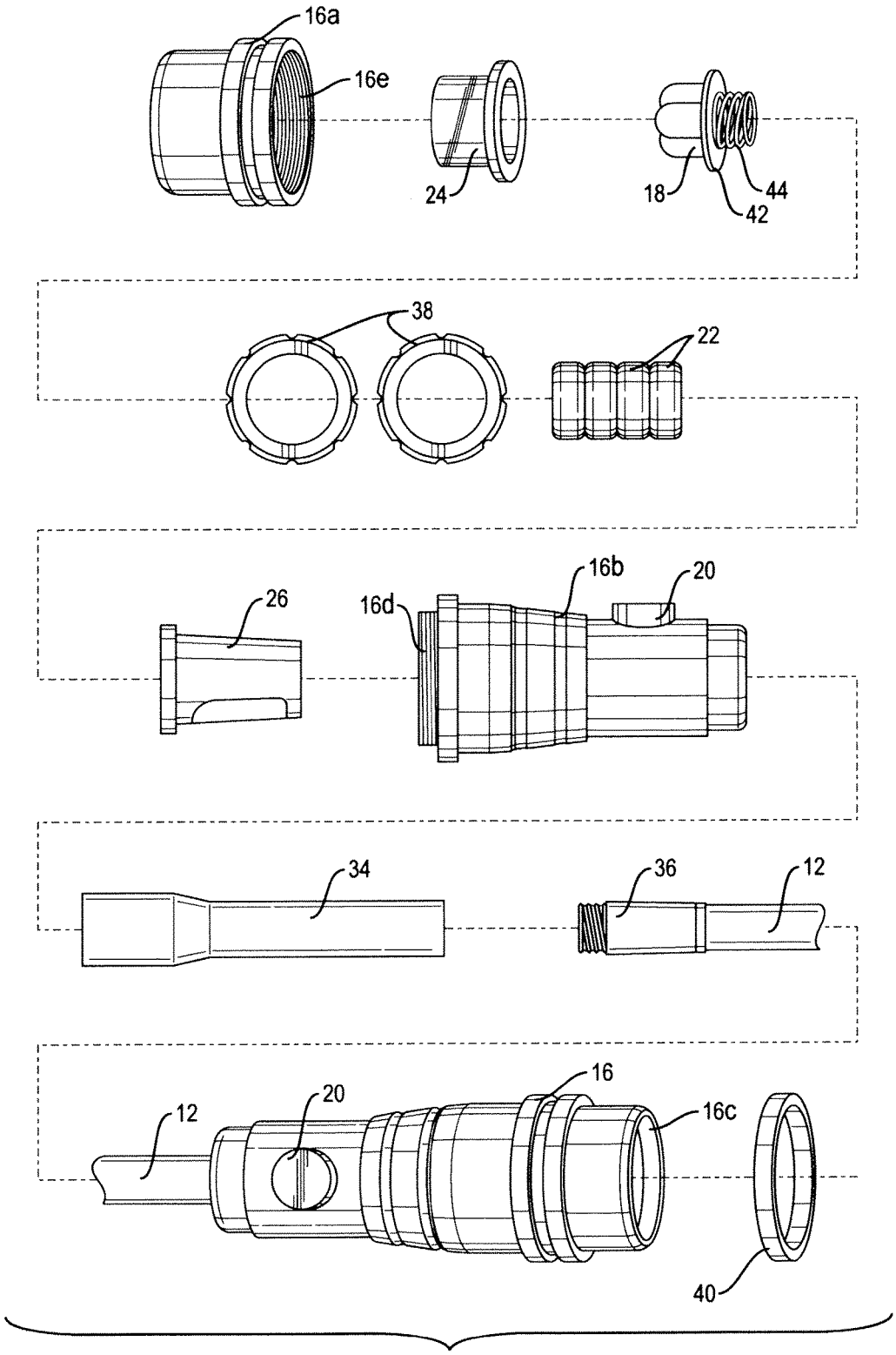
FIG. 2 is an exploded view of the assembly with part of its bendable shaft removed for clarity.

According to the invention, and as noted, there is no enlarged battery section along the shaft 12. Instead, and as best shown in FIG. 2, a separate self-powered flashlight assembly 14 is fixed to each end of the shaft 12, each flashlight assembly comprising a housing 16 containing an LED circuit with at least one, but preferably three LEDs 18, a pushbutton switch 20 having open and closed positions for respectively interrupting and passing electricity to the LEDs 18, and at least one battery 22 for powering the LED or LEDs when the switch is closed. Preferably, four button batteries 22 are held in a cylindrical battery holder 26 having opposite open ends for holding the stack of button batteries 22.

Each flashlight assembly housing 16 has one end fixed to one end of the shaft 12 and an opposite end, a clear lens 24 covering the opposite end of the housing and extending over the one or more LEDs, and a magnetic ring 40 around the lens 24 and in this opposite end of the housing.

Figure 3:
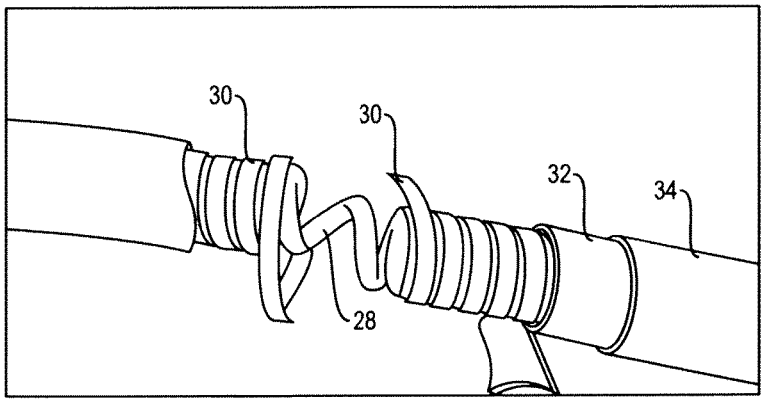
FIG. 3 is an enlarge view of an area of the shaft disassembled to reveal its inner structure.

The bendable elongated shaft 12, in a preferred embodiment of the invention, comprises an inner spring metal coil 28 made of, for example, carbon steel, and an outer malleable metal coil 30 made of, for example, galvanized iron wire having a silver color and tightly wrapped and coiled around the inner coil 28, with turns of outer coil 30 alternating with turns of the inner coil. The cross section of the wire making up the inner coil 28, as best shown in FIG. 3, is generally circular, and the cross section of the wire making up the outer coil 30 generally triangular. The turns of the coils 28 and 30 are firmly pressed or formed together and the combination of a resilient inner coil 28 and malleable outer coil 30 work together the make the shaft 12 easily bendable into almost any selected shape or configuration.

Each flashlight assembly housing 16 has a outer end portion 16*a* with female threads 16*e*, and inner end portion 16*b* with male threads 16*d*. Threads 16*d* and 16*e* are threaded to each other to close the housing after the LED circuit is inserted. The circuit included LEDs 18 mounted to an LED mounting disc 42 with battery contact spring 44 that contacts the positive end of the first battery 22 in the button battery stack in holder 26, the negative end of the last battery contacting a flexible contact in housing portion 16*b*. After the lens 24 and disc 42 are inserted into the housing portion 16*a* form the rear, disc retaining rings 38 are threaded to the base of threads 16*e* to retain disc 42 with LEDs 18 and the top-hat shaped lens 24 in the housing portion 16*a*, behind a magnetic ring 40 that was previously bonded into an annular shelf 16*c* in outer end of housing portion 16*a* by strong adhesive.

In combination with the elongated bendable shaft 12, the magnet 40 at each flashlight assembly 14 can be used to reach hard to reach small magnetically attractable parts that may have fallen into inaccessible places, like behind pieces of furniture or the like.

Figure 4:
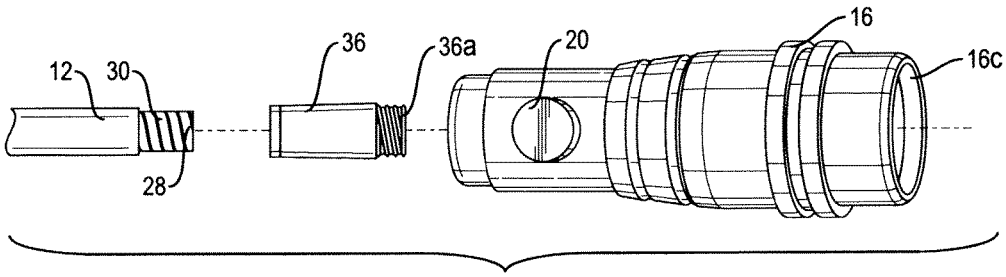
FIG. 4 is an exploded view of one of the flashlight assembles.

The flashlight arrangement includes a cylindrical adaptor 36 as best shown in FIG. 4, having one end with an opening for fixedly receiving one end of the shaft 12, and a projection 36*a* at its opposite end, fixedly received in one end of the flashlight assembly housing 16 for fixing the flashlight assembly 14 to the end of the shaft 12. Adaptor 36 is aluminum and is fixed to an end region of shaft 12 that has no cover layer so that the outer surface of the galvanized iron coil 30 is in direct contact with the inner aluminum surface inside the opening in the adaptor. A square punch machine is then used to crimp the initially cylindrical end of adaptor 36 into a somewhat square cross section, and inwardly onto the end portion of shaft 12 that is inside the adaptor to intimately fix the adaptor to the shaft. The opposite end projection 36*a* is threaded to mating threads in the end of housing 16 and is bonded in place using strong adhesive. This securely fixes the flashlight assembly housing 16 and therefore the flashlight assembly 14, to the end of the shaft 12.

Examples of the materials use to manufacture the various parts of the arrangement of the invention are as follows, although any alternate materials known to the person of ordinary skill in the art, or yet to be discovered, that are suitable to the purposes of the invention, may be used. Inner coil 28 may be made of spring steel that is round in cross section is tempered so as to be resilient, e.g. carbon steel. Outer coil 30 may be made of softer galvanized iron with a substantially triangular cross section pointing inwardly so the surface of its inner turns wrap closely around the outer spaces between the turns of the inner coil 28 as shown in FIG. 3. By combining the resilient, spring metal inner coil 28, with the closely wrapped malleable metal outer coil 30, the coils interact in such a way that the shaft 12, can be easily bent and stays bent into any selected position and configuration. FIGS. 1 and 5 to 8 illustrate some of these positions and configurations.

Plastic or elastomer cover layer 32 over the outer coil is made, for example, of PE (polyethylene), and plastic sheath or sleeve 34 over the elastomer cover 32 at the opposite ends of the shaft 12, adjacent the respective flashlight assemblies 14, is made, for example, of PET (polyethylene terephthalate).

In some embodiments of the invention, the sheath or sleeve 34 can be eliminated. Any selected color can be used for the cover layer 32 for making a wide variety of selections of the invention for the market including black and white as well as all primary colors (e.g. red, blue and green) and any number of secondary colors (e.g. yellow, purple, or blends or shades of any color).

Figure 5:
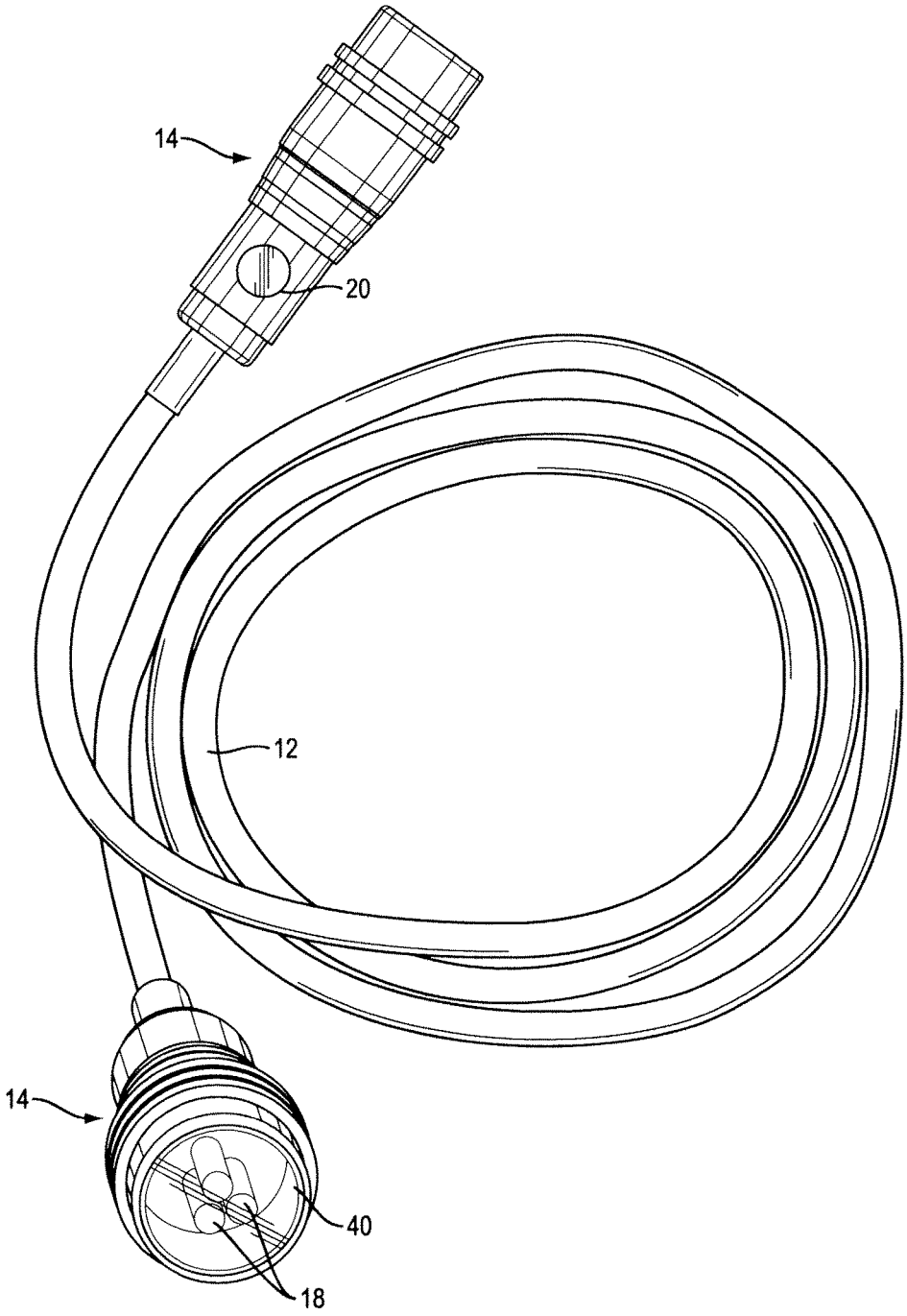
FIG. 5 is a perspective view of another embodiment of the invention.

In one embodiment of the invention shown in the FIG. 5, the cover layer is eliminated altogether and the flashlight assembly housings and switch cover are silver for a bright metallic, and therefore, substantial appearance for the entire arrangement. All exposed surfaced may alternatively by coated, plated or treated to produce and shiny or mat metallic color for a well constructed and attractive appearance for the arrangement.

Figure 6:
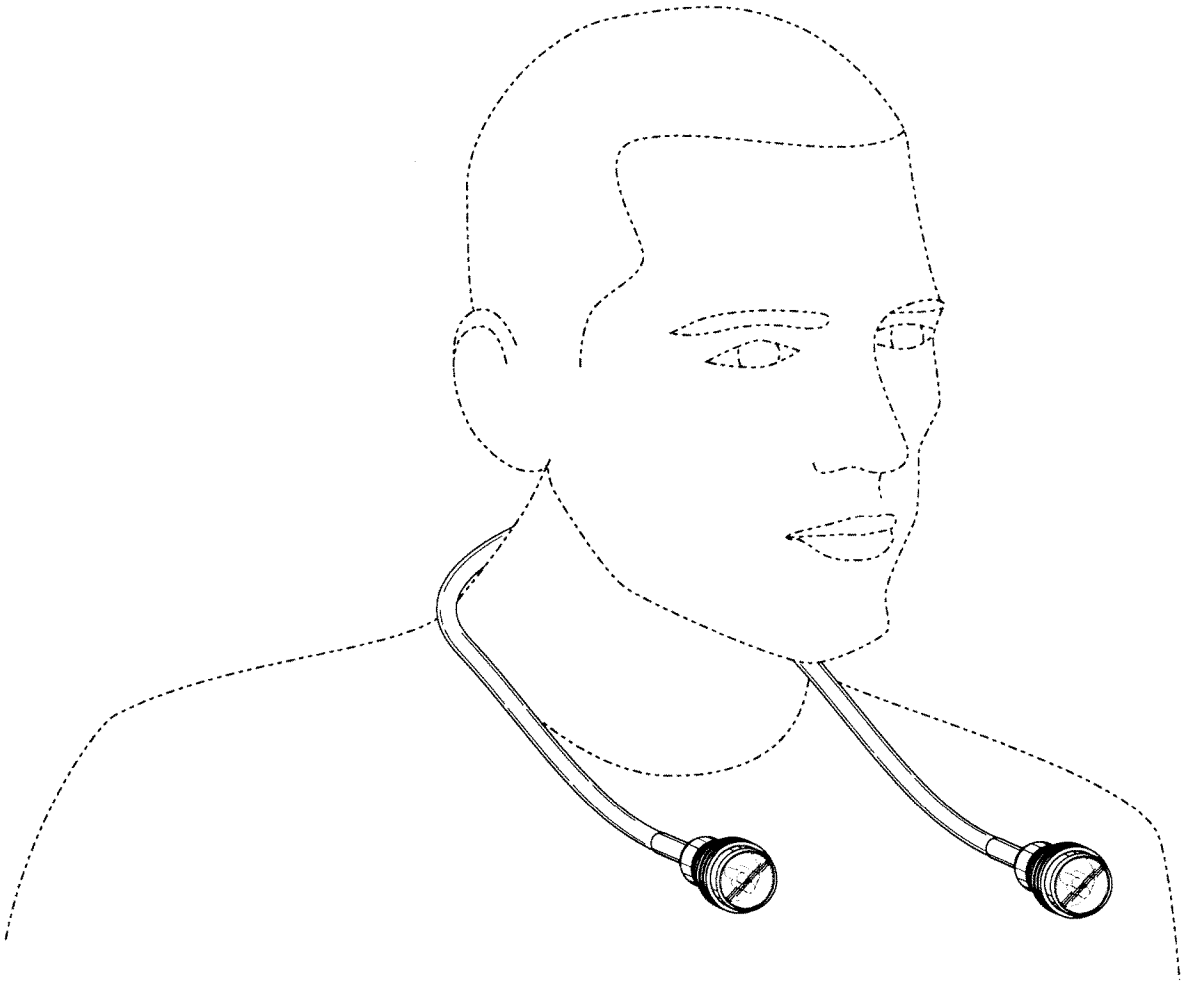
FIG. 6 is a perspective view of an embodiment of the invention shown with its bendable shaft bent into a different selected shape.
Figure 7:
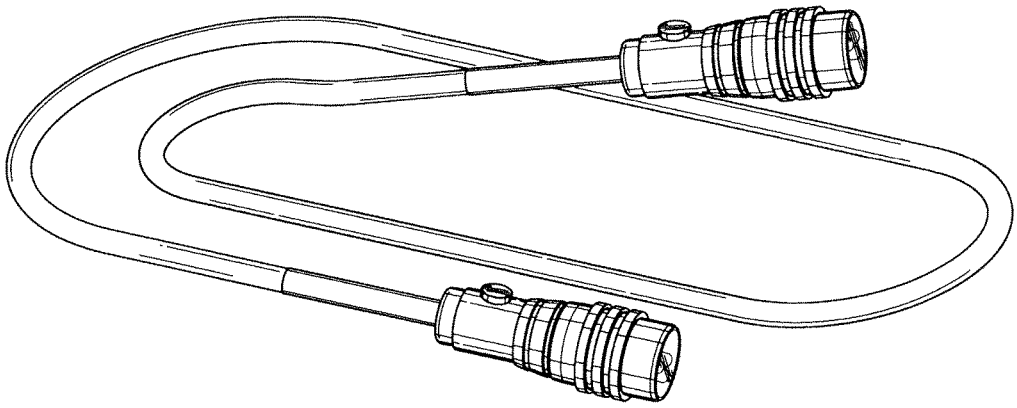
FIG. 7 is a perspective view of an embodiment of the invention shown with its bendable shaft bent into a still further different selected shape.
Figure 8:
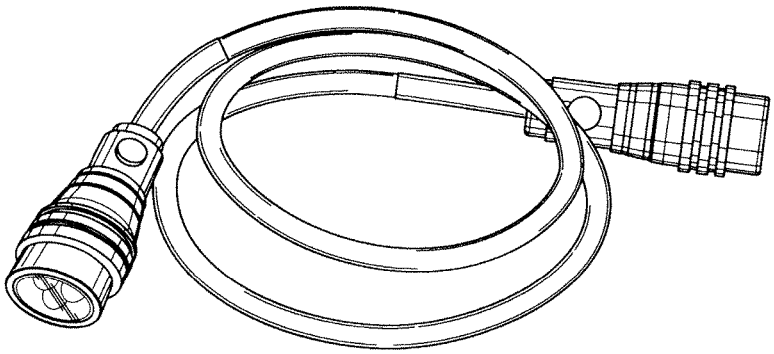
FIG. 8 is a perspective view of an embodiment of the invention shown with its bendable shaft bent into another selected shape.

In the shape or configuration into which the bendable shaft has been bend in FIG. 6, it can be wrapped behind the neck of the used with the flashlight assemblies aimed forward so that the used can shed light on a subject in a hands-free manner. FIG. 7 shows a configuration of the bent shaft for support of the arrangement on a surface to aim the light of one or both flashlight assemblies in one or two desired directions. FIG. 8 is a perspective view of the invention with its bendable shaft bent into a configuration that can wrap around a post of pole. These are only a few of the many number of configurations the invention may take, due it the easy bendability of it shaft, its relatively small diameter and long length, and the presence of two self-powered flashlight assembles.

While specific embodiments of the invention have been shown and described in detail to illustrate the application of the principles of the invention, it will be understood that the invention may be embodied otherwise without departing from such principles.

What is claimed is:

1. A flexible, two headed flashlight arrangement (10), comprising:

a bendable elongated shaft (12) having opposite ends, the shaft having a diameter of about 5 mm (about 3/16 inch) to about 10 mm (about 3/8 inch) that is substantially constant between the opposite ends, a length of about 610 mm (about 24 inch) to about 1220 mm (about 48 inch), and being bendable into any selected shape; and a separate self-powered flashlight assembly (14) fixed to each end of the shaft (12), each flashlight assembly comprising a housing (16) containing an LED circuit with at least one LED (18), a switch (20) having open and closed positions for respectively interrupting and passing electricity to the LED (18) and at least one battery (22) for powering the LED when the switch is closed;

each flashlight assembly housing (16) having one end fixed to one end of the shaft (12) and an opposite end, a lens (24) covering the opposite end of the housing and extending over the at least one LED, and a magnetic ring (40) around the lens (24) and in the opposite end of the housing.

2. The flexible, two headed flashlight arrangement of claim 1, including a plurality of LEDs (18) and a stack of button batteries (22) in the LED circuit.

3. The flexible, two headed flashlight arrangement of claim 1, including a plurality of LEDs (18) and a stack of button batteries (22) in the LED circuit, and a cylindrical button battery holder (26) having opposite open ends for holding the stack of button batteries (22).

4. A flexible, two headed flashlight arrangement (10), comprising:

a bendable elongated shaft (12) having opposite ends, the shaft having a diameter of about 5 mm (about 3/16 inch) to about 10 mm (about 3/8 inch) that is substantially constant between the opposite ends, a length of about 610 mm (about 24 inch) to about 1220 mm (about 48 inch), and being bendable into any selected shape; and a separate self-powered flashlight assembly (14) fixed to each end of the shaft (12), each flashlight assembly comprising a housing (16) containing an LED circuit with at least one LED (18), a switch (20) having open and closed positions for respectively interrupting and passing electricity to the LED (18) and at least one battery (22) for powering the LED when the switch is closed;

wherein the bendable elongated shaft (12) comprises an inner spring metal coil (28) and an outer malleable metal coil (30) coiled around the inner coil with turns that alternate with turns of the inner coil.

5. The flexible, two headed flashlight arrangement of claim 4, including an elastomer cover (32) over the outer coil.

6. The flexible, two headed flashlight arrangement of claim 4, including an elastomer cover (32) over the outer coil, and a plastic sheath (34) over the elastomer cover (32) at the opposite ends of the shaft adjacent the respective flashlight assemblies (14).

7. A flexible, two headed flashlight arrangement (10), comprising:

a bendable elongated shaft (12) having opposite ends, the shaft having a diameter of about 5 mm (about 3/16 inch) to about 10 mm (about 3/8 inch) that is substantially constant between the opposite ends, a length of about 610 mm (about 24 inch) to about 1220 mm (about 48 inch), and being bendable into any selected shape;

a separate self-powered flashlight assembly (14) fixed to each end of the shaft (12), each flashlight assembly comprising a housing (16) containing an LED circuit with at least one LED (18), a switch (20) having open and closed positions for respectively interrupting and passing electricity to the LED (18) and at least one battery (22) for powering the LED when the switch is closed; and an adaptor (36) having an opening at one end for fixedly receiving one end of the shaft (12), and a projection (**36*a*) at its opposite end, fixedly received in one end of the flashlight assembly housing (16) for fixing the flashlight assembly (14) to the end of the shaft (12**).

8. The flexible, two headed flashlight arrangement of claim 7, the adaptor being crimped at its one end for fixing the adaptor to the shaft.

9. The flexible, two headed flashlight arrangement of claim 7, the adaptor being crimped at its one end for fixing the adaptor to the shaft, the projection (**36*a*) being threaded and adhered into one end of the flashlight assembly housing (16) for fixing the flashlight assembly (14) to the end of the shaft (12**).

10. The flexible, two headed flashlight arrangement of claim 7, wherein the flashlight assembly housing (16) and the bendable shaft (12) have a metallic outer appearance.

11. A flexible, two headed flashlight arrangement (10), comprising:

a bendable elongated shaft (12) having opposite ends, the shaft having a diameter of about 5 mm (about 3/16 inch) to about 10 mm (about 3/8 inch) that is substantially constant between the opposite ends, a length of about 610 mm (about 24 inch) to about 1220 mm (about 48 inch), and being bendable into any selected shape;

a separate self-powered flashlight assembly (14) fixed to each end of the shaft (12), each flashlight assembly comprising a housing (16) containing an LED circuit with at least one LED (18), a switch (20) having open and closed positions for respectively interrupting and passing electricity to the LED (18) and at least one battery (22) for powering the LED when the switch is closed; and wherein the bendable elongated shaft (12) comprises an inner spring metal coil (28) and an outer malleable metal coil (30) coiled around the inner coil with turns that alternate with turns of the inner coil, the outer surface of the outer coil (30) and the flashlight assembly housing (16) having a metallic outer appearance.

12. The flexible, two headed flashlight arrangement of claim 1, the arrangement including a plurality of LEDs (18) and a stack of button batteries (22) in the LED circuit and a cylindrical button battery holder (26) having opposite open ends for holding the stack of button batteries (22).

13. A flexible, two headed flashlight arrangement (10), comprising:

a bendable elongated shaft (12) of substantially constant diameter along its length, the shaft having opposite ends; and a separate self-powered flashlight assembly (14) fixed to each end of the shaft (12), each flashlight assembly comprising a housing (16) containing an LED circuit with at least one LED (18), a switch (20) having open and closed positions for respectively interrupting and passing electricity to the LED (18) and at least one battery (22) for powering the LED when the switch is closed;

the bendable elongated shaft (12) comprising an inner spring metal coil (28) and an outer malleable metal coil (30) coiled tightly wrapped around the inner coil with turns that alternate with turns of the inner coil.

14. The flexible, two headed flashlight arrangement of claim 13, wherein the shaft (12) has a diameter of about 5 mm (about 3/16 inch) to about 10 mm (about 3/8 inch) that is substantially constant between the opposite ends, a length of about 610 mm (about 24 inch) to about 1220 mm (about 48 inch), and being bendable into any selected shape.

15. The flexible, two headed flashlight arrangement of claim 13, including an adaptor (36) having an opening at one end for fixedly receiving one end of the shaft (12), and a projection (36*a*) at its opposite end, fixedly received in one end of the flashlight assembly housing (16) for fixing the flashlight assembly (14) to the end of the shaft (12).

16. The flexible, two headed flashlight arrangement of claim 13, including an adaptor (36) having an opening at one end for receiving one end of the shaft (12), the adaptor being crimped at its one end for fixing the adaptor to the shaft, the adaptor having an opposite end with a projection (36*a*) that is fixedly received in one end of the flashlight assembly housing (16) for fixing the flashlight assembly (14) to the end of the shaft (12).

17. The flexible, two headed flashlight arrangement of claim 13, including an adaptor (36) having an opening at one end for receiving one end of the shaft (12), the adaptor being crimped at its one end for fixing the adaptor to the shaft, the adaptor having an opposite end with a threaded projection (36*a*) that is threaded and adhered into one end of the flashlight assembly housing (16) for fixing the flashlight assembly (14) to the end of the shaft (12).

18. The flexible, two headed flashlight arrangement of claim 13, wherein the flashlight assembly housing (16) and the bendable shaft (12) have a metallic outer appearance.

19. The flexible, two headed flashlight arrangement of claim 13, including an elastomer cover (32) over the outer coil.

* * * * *